United States Patent [19]

Hass

[11] 4,004,653

[45] Jan. 25, 1977

[54] GRAVE FRAME

[76] Inventor: Ray C. Hass, Niles Road, St. Joseph, Mich. 49085

[22] Filed: July 14, 1975

[21] Appl. No.: 595,350

[52] U.S. Cl. ..... 182/128; 182/132; 27/29

[51] Int. Cl.[2] ..... E04G 25/00

[58] Field of Search ..... 182/128, 178, 179, 130, 182/131, 132, 107, 108; 27/29; 61/41 A

[56] References Cited

UNITED STATES PATENTS

| | | | |
|---|---|---|---|
| 1,348,405 | 8/1920 | Goodwin | 27/29 |
| 3,508,666 | 4/1970 | Schwengel | 182/178 |
| 3,541,799 | 11/1970 | Jost | 61/41 A |
| 3,679,026 | 7/1972 | Hansen | 182/132 |
| 3,788,086 | 1/1974 | West | 61/41 A |
| 3,922,866 | 12/1975 | Benning | 61/41 A |

FOREIGN PATENTS OR APPLICATIONS

| | | | |
|---|---|---|---|
| 1,452,807 | 8/1966 | France | 182/107 |
| 1,007,133 | 10/1965 | United Kingdom | 182/178 |

*Primary Examiner*—Reinaldo P. Machado
*Attorney, Agent, or Firm*—Eric S. Spector

[57] ABSTRACT

An assembly is shown, which provides a framework that fits in an excavation such as a grave, including two side frames that exert considerable horizontal pressure against two end frames by means of eight horizontal adjustable screws and integral bearing means to produce a rigid frame adapted for carrying heavy surface loads for example, machinery for lowering a casket into the grave and providing a support for a platform for mourners adjacent to the grave for those wishing to approach closely to the graveside. The load on the rigid frame and including any load from the platform supported on the frame is transmitted to bearing pads supported on the floor of the excavation to eliminate, insofar as possible, injury, and/or embarrassment caused by the caving in of the walls of the excavation while at the same time making it possible to provide a much neater appearing gravesite than would be attainable without the framework.

4 Claims, 6 Drawing Figures

Fig. 2
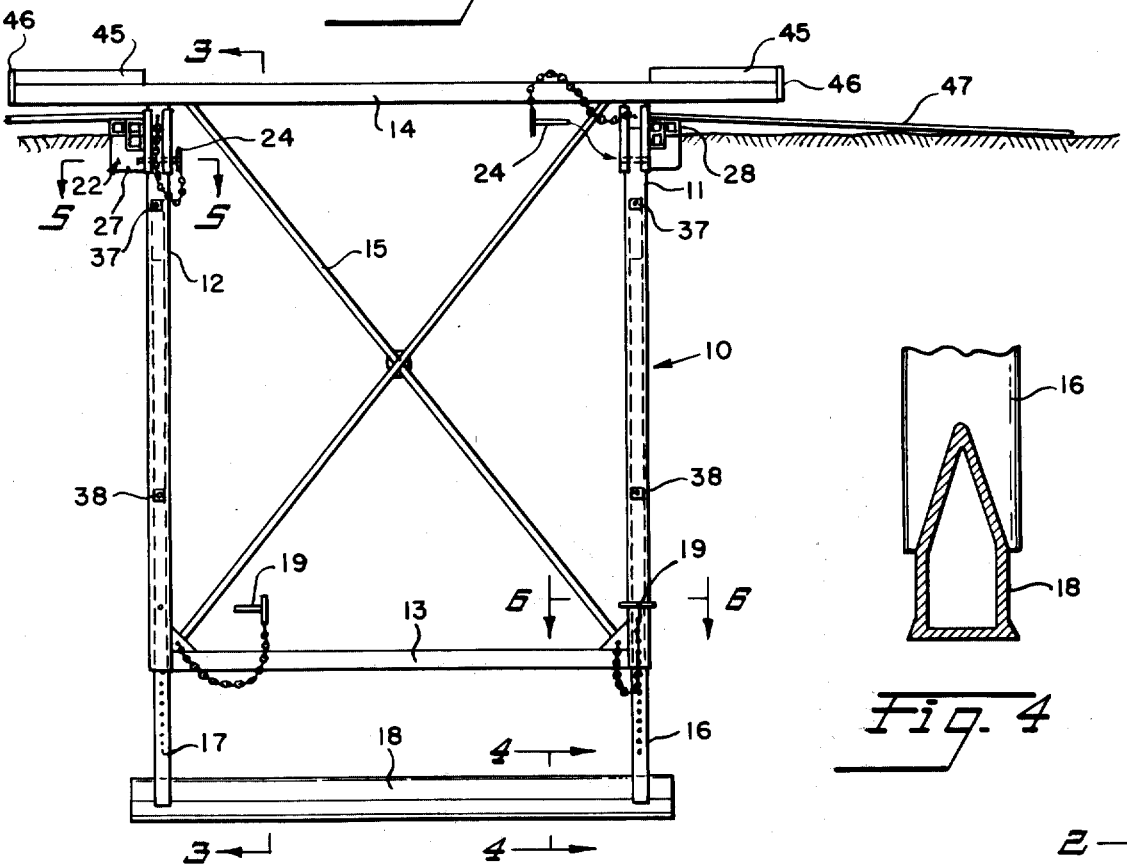
Fig. 4
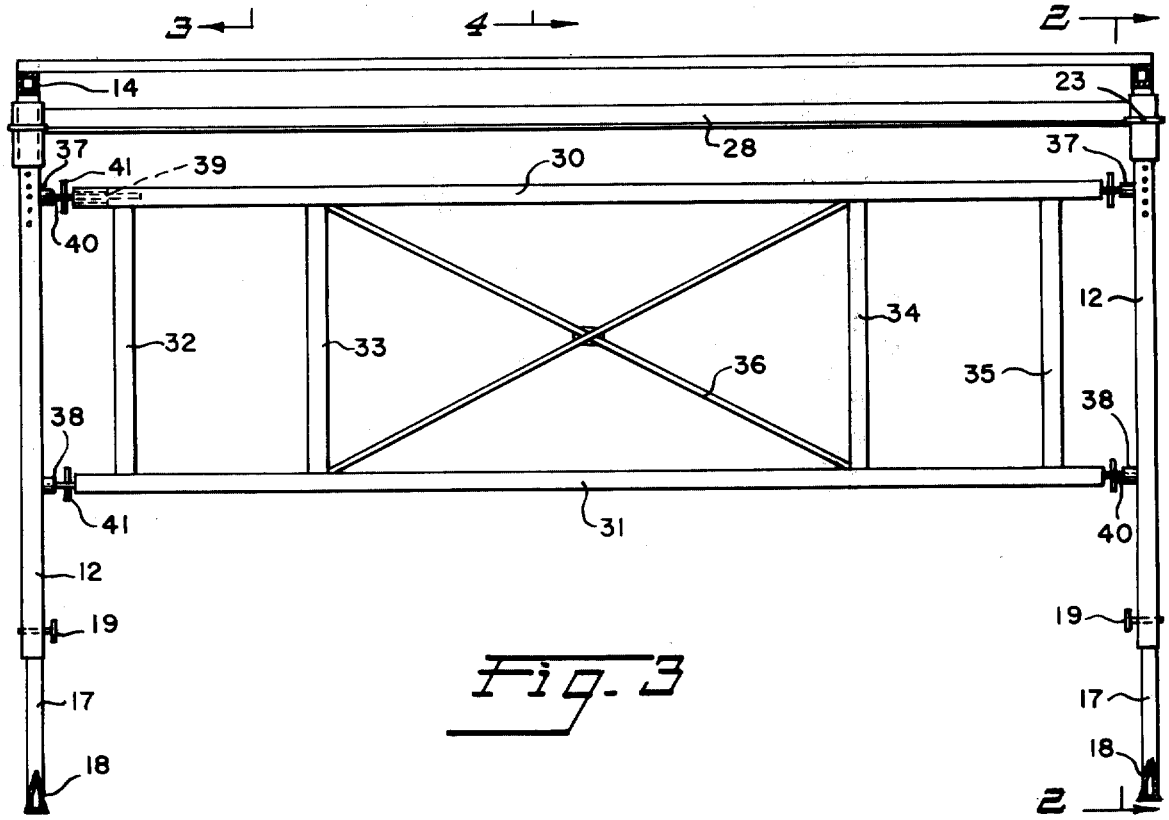
Fig. 3

GRAVE FRAME

BACKGROUND OF THE INVENTION

Excavations in the ground such as for graves, particularly those made in certain soils including generally sandy types, are particularly subject to caving in when people move about adjacent to the edges thereof. At a gravesite some means must be provided to support the machinery which is used for lowering the casket into the grave, and well supported bearing surfaces, usually in the form of plywood boards, are positioned adjacent to the sides of the grave so that the mourners, the pallbearers and the minister can stand at the side of the grave with no fear of a cave-in of the walls of the grave. A number of devices have been used over a period of many years in various attempts to provide a universally applicable support means for the walls of the grave as exemplified in the disclosures of U.S. Pat. Nos. to Knarr, 571,090, Spear, 673,549, Shults, 470,767, and a device used to support the casket lowering machinery as exemplified in the disclosure of U.S. Pat. No. to Hanks, 2,221,134. The above mentioned devices, for one reason or another, were not practical, and to the best of my knowledge, are not now in use. At the present time, the method most commonly used is to build a framework of timbers and planks around the sides and ends of the grave, all above ground, in such a way as to provide a support for the casket lowering machinery and a support for the edges of plywood boards nearest the grave. All of this criss-cross structure of timbers and planks is covered with green cloth having the appearance of grass. Because of the number of timbers and planks needed, a variety of obstructions exist, such as the corners of the framework. This makes it necessary for the minister, pallbearers, and mourners to step over the obstructions. Since all of this timber is supported by the ground adjacent to the edges of the excavation for the grave, there is always the danger of a serious cave-in which might cause injury to the mourners and others present, or at the least, a very embarrassing incident. The present invention provides an improvement on such teachings.

BRIEF DESCRIPTION OF THE INVENTION

The invention here shown makes use of lightweight, non-corrosive, fabricated panel structures, consisting of two end frames supported on bearing pads on the floor of the grave, which panel structures can be adjusted vertically to adapt to various grave depths. Two side frames are provided for rigid connection to the end panels by means of horizontally adjustable screws that provide a pressure against the end frames thus providing a very rigid rectangular framework. The assembled rigid frame is easily adapted to fit into graves of varying length, and depth. Within reason, the framework may be assembled in graves of varying widths. The entire assembled structure, once it is built up within the excavation, is supported from the floor of the excavation so that loads transmitted to the framework can be easily carried without subjecting the top edges of the walls of the excavation to pressures that might start a cave-in. The end frames may be arranged to carry means for supporting the four corner posts of the casket lowering machinery. Additionally, side support bars, which are carried by support means adjustably mounted on the vertical members of the end frames, provide support for the edges of the plywood boards laid flat on the earth adjacent to the grave. The complete framework and bearing structure associated therewith is adapted to transmit all the loads imposed thereon to the bearing pads on the floor of the grave whereby substantial loads on the corner post machinery supporting means and the plywood laid on the earth immediately around the excavation can be tolerated without fear of a cave-in.

The framework also serves as a support for the machinery used prior to the funeral services for lowering the vault into the grave. The frame is used in the same manner for lowering the vault lid into the grave after the services have been concluded and the mourners have departed. Cave-ins may sometimes occur after the framework is placed in the grave and before the vault can be lowered into place; in such cases, the framework serves as an aid to the workers in getting into and out of the grave for the purpose of shoveling out the fallen earth.

After the burial service has been completed, and after the vault lid has been secured, the framework may be disassembled from above the vault for easy removal from the grave.

Since the necessity for using the criss-cross framework surrounding the edges of the grave is eliminated by the means here shown, the resulting gravesite has a much neater appearance with comparatively no obstructions for people to trip over. The end frames do exert a pressure against the walls of the grave ends; therefore, the framework does to some extent serve to prevent some of the cave-ins that might otherwise occur at the ends of the grave; but, the objective of this invention is not so much to prevent cave-ins, as it is to eliminate any possible injury from cave-ins, to eliminate the worry or fear of cave-ins, and to provide a much neater gravesite.

BRIEF DESCRIPTION OF THE DRAWINGS

FIG. 2 is a sectional end elevation of a frame for fitting against an end wall of the excavation taken on line 2—2 of FIG. 3;

FIG. 3 is a sectional side elevation of an assembled framework taken on line 3—3 of FIG. 2 with the cross braces of the end panel omitted;

FIG. 4 is an enlarged sectional view taken on line 4—4 of FIG. 2;

DETAILED DESCRIPTION

The preferred form of this invention provides a four sided rectangular aluminum framework adapted to be fitted into an excavation such as a grave. The structure has a bearing on the floor of the excavation and includes various bearing elements for transmitting surface loads that might otherwise be imposed on the earth surrounding the excavation, to the framework to be carried thereby and transmitted to the floor, in order to minimize the risk of causing the walls of the excavation to cave in. The framework may be fabricated in any lightweight panel design, and a rigid lightweight tubular frame with suitable cross bracing has been found to be most satisfactory for this purpose. End panel means are provided that include bearing means for carrying the assembled frame on the floor and side panel means supported between the end panels.

Figure 1:
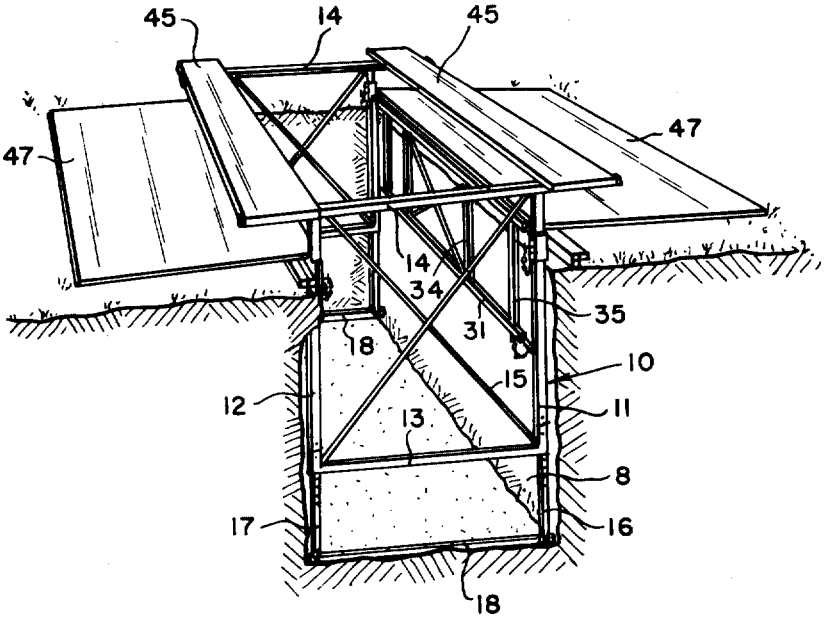
FIG. 1 is a perspective view partly broken away showing the framework and bearing supports assembled in and around an excavation.
Figure 6:
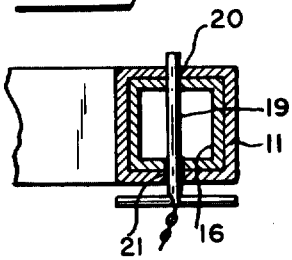
FIG. 6 is a detail in cross section of the pinned telescopic leg elements used for adjustment of the end frames to the height of the excavation taken on line 6—6 of FIG. 2.

Referring to FIGS. 1 and 2, the end panel structures each includes an upper section 10 having hollow vertical sides or posts 11 and 12. The horizontal sides 13 and 14 are joined to sides 11 and 12, together with suitable cross bracing 15 to provide a rigid upper section. The upper crossbar 14 extends beyond the side walls 8 of the excavation for a purpose that will appear more fully below. The lower portion of the end panel is a U-shaped element having side legs 16 and 17 that are supported integrally from a rigid bearing foot 18 that may have the cross-sectional shape shown in FIG. 4. The legs 16 and 17 are each adapted to have a telescopically interfitted connection with sides 11 and 12 respectively of the top section and both of the interfitted sides and leg elements are designed to be held in a selected adjusted position by pins 19 that, as shown in FIG. 6, slide into the pairs of aligned apertures 20 and 21 in the respective cooperating leg elements 16 and 11, and 17 and 12.

The upper sections 10 each support a pair of J-shaped brackets 22 that may be pinned in adjusted positions to the upper ends of each of the vertical sides 11 and 12. The J brackets each has a C-shaped body portion 23 that surrounds and slides vertically along the side to which the J bracket is fitted and it may be pinned in a fixed position with a pin 24 as shown in Flg. 5, that fits into pairs of aligned apertures 25 and 26 in the C-shaped body and side 12 for example. The brackets each have a hook portion 27 for supporting an L-shaped bar 28 on each side of the grave as indicated in FIG. 2, the bars passing over and along each of the side edges of the excavation, each bar rather snugly fits into the hook of the J to be held there frictionally. The purpose of bars 28 will appear more fully below.

Figure 5:
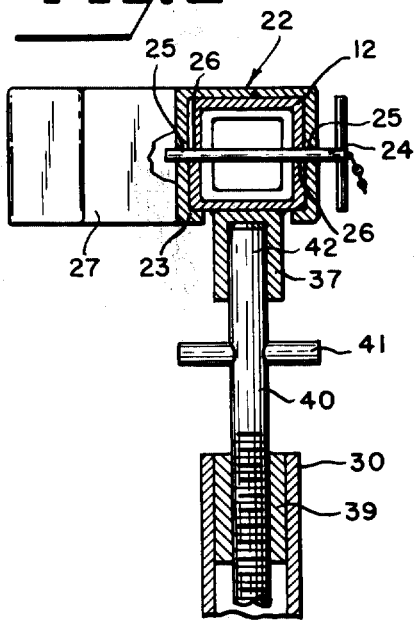
FIG. 5 is a detail in cross section taken on line 5—5 of FIG. 2.

The side panel means are identical and each panel as shown in FIG. 3 has an upper side rail 30 and lower side rail 31. The rails 30 and 31 may be joined by vertical posts 32, 33, 34, and 35 and the side panel is completed with cross bracing 36. The side panels are supported between the oppositely positioned side legs of the end panels and for this purpose the four side legs 11 and 12 of both the end sections are each provided with a pair of sockets 37 and 38 integral therewith. The sockets are spaced along the legs to be positioned opposite the ends of the horizontal bars 30 and 31 of the side panels. Both ends of bars 30 and 31 are fitted with fixedly mounted threaded bushings 39 as best seen in FIG. 3 and in FIG. 5, to cooperate with elongated threaded bars 40. The bars 40 have cross pieces 41 integral therewith and have rounded bearing ends 42 for rotatably fitting into sockets 37 and 38.

The structure so far described may be easily assembled in any gravesite excavation within the limits of its design. The end panels preferably have a width a few inches less than the width of the excavation and the telescopic interfit of side legs 16 and 17 of the bottom section of each end panel in sides 11 and 12 permits the U-shaped bottom section to be adjusted to reach the floor of the excavation with the bars 14 of both of the end panels in the same horizontal plane and J-shaped brackets 22 spaced about even with the edges of the excavation. The two end panels are then placed in the excavation adjacent the opposite ends thereof and L-shaped bars 28 are fitted into the J brackets 22 to temporarily hold the ends erect, supported from the floor of the excavation on the wide bearing surfaces on the undersides of the foot elements 18. The side panels are then loosely mounted on the end panels by screwing bars 40 outwardly to engage in sockets 37 and 38. When all of the end and side panels have been loosely joined together and properly situated in the desired position in a particular excavation, the bars 40 are all screwed out to, in effect, elongate the side panels and tighten the side panels in their mountings. When bars 40 are driven into the sockets 37 and 38, they drive the end panels firmly against the end walls of the excavation.

The framework is thus tightly mounted within the excavation and the end panels provide some support for the earthen walls at the ends of the excavation. The side frames do not necessarily touch the side walls of the excavation.

The above ground structure of the framework is adapted to support bearing means 45 for carrying heavy loads without imposing any loads on the earth adjacent to the sides of the excavation, which loading might otherwise produce a cave-in within the excavation if allowed to take place. For this purpose, bars 14, as best seen in FIGS. 1 and 2 extend above the surface of the earth and beyond the edges of the excavation. The extending ends of bars 14 each carry the ends of boards 45 that may be held in position on bars 14 by stops 46 integral with the tip ends of bars 14. The boards 45 are adapted to carry machinery such as a means for supporting and then lowering a vault or a casket into the grave. The end panels are initially adjusted by means of the telescopically interfitted U-shaped bottom section, as above explained, so that the bars 14 are made to lie in a horizontal plane parallel with the floor of the grave and thus the bearing boards 45 are properly positioned relative to the grave. The machinery for lowering the casket or vault is supported on boards 45 which transfer the load to elements 10 and 18 as seen in FIG. 2 and then to the floor of the grave so that no stress is transferred to the earth forming the walls around the grave whereby the possibility of causing a cave-in by overloading the earth, especially in sandy soils, from this necessary activity, is eliminated.

Insofar as the J brackets 22 and L-shaped oars 28 are concerned, these elements also provide additional support for additional bearing panels 47 best seen in FIG. 1. A typical panel is a 48 × 96 × ⅝ inch sheet of plywood that rests on the bar 28 along one 96 inch side and along the other side, remote from the excavation, on the earth. During graveside services, the panels 47, that may be disposed on both sides of the grave, support persons who may approach closely toward the grave without overloading the earth near the excavation to cause cave-ins. But, even if a cave-in should occur from natural conditions in the soil, the persons on panels 47 would be protected from injury because the panels would span the void left by the falling soil and since the sides of the panels at the edge of the excavation are carried on bars 28, supported on the end panels having a bearing on the floor of the excavation, the mourners would be saved injury.

In a situation where the grave may be located on a slight incline, the J brackets 22 can be pinned to their respective side bars 11 and 12 at the opposite ends of the excavation in positions to hold bars 28 on each side parallel to the surface of the incline or contour of the earth. The panels 47 are then supported in a manner to follow the natural slope of the soil to be relatively unobtrusive when covered with simulated grass carpeting. It should be noted that the bearing supports 45, however, remain level to support the casket or vault lowering equipment in a properly aligned position relative to the excavation.

After the burial services have been completed, the various elements of the assembly may be easily removed. The framework can be taken apart simply by loosening the threaded bars 40 carried by the side panels to withdraw bearing ends 42 from sockets 37 and 38 so the side panels can be lifted free. Even when some debris or even if a cave-in has occurred, the side panels will remain unencumbered and the end panels can be lifted free. When the end panels are to be removed, even after a cave-in, this is accomplished without difficulty because the upper knife edge shape of each of the foot elements 18 cuts through the fallen earth to permit the end panels to be easily lifted from the floor when the end panels are removed as a unit.

All of the panels described above may be made of a lightweight but sturdy aluminum alloy material. Each of the elements of the individual panel structures may be welded together to provide the desired rigid structures. Once the end panels have been adjusted to properly fit into the grave, with the bars 14 in proper horizontal position, the two rigid side panels may be quickly installed and the entire end and side panel framework rigidified by tightening the threaded bars 40 into sockets 37 and 38. A very neat grave area may then be prepared, with bearing means for all of the anticipated loads. The rigidified framework is designed to transmit all of the loads imposed thereon onto the floor of the grave through bearing means 18, all as above described.

While the above description covers a preferred form of my invention, it is possible that modifications thereof may occur to those skilled in the art that will fall within the scope of the following claims.

I claim:

1. A rectangular framework for excavations such as graves and the like comprising a. rigid end members extending from the top to the bottom of the excavation, said end members being adapted to engage the opposite ends of the excavation and to be supported on the floor of the excavation;

b. rigid side means;

c. elements included in said side means, each having ends adapted to be supported on said end members positioned at the opposite ends of the excavation;

d. means on said end members for engaging the ends of said elements (c);

e. means to elongate said elements (c) against said means (d) whereby to press said end members against the opposite ends of said excavation and hold said side means tightly between said means (d) thus providing a rigid framework;

f. adjustable brackets supported on said framework, said brackets being adapted to carry floor support means that extends longitudinally parallel to and slightly above a side edge of the excavation whereby a rigid floor means may be laid nearly flat adjacent the excavation to support heavy weights near the edge thereof without the risk of injury to persons standing thereon from a cave-in.

2. A structure as in claim 1 wherein each of said rigid end members is fabricated of lightweight tubing including vertically disposed tubes and cross bracing and each of said adjustable brackets is interfitted with one of said vertically disposed tubes to be adjustable.

3. A structure as in claim 2 wherein each of said rigid end members carries an integral crossbar at the top end thereof to be positioned in the same horizontal plane above the earth at the respective ends of the excavation, said crossbars being adapted to support load carrying elements in a horizontal plane adjacent the periphery of the excavation.

4. A rectangular framework for excavations such as graves and the like comprising a. rigid end members in the form of panels fabricated of lightweight tubing and cross bracing and extending from the top to the bottom of the excavation, said end members being adapted to engage the opposite ends of the excavation and to be supported on the floor of the excavation;

b. rigid side means in the form of panels fabricated of lightweight tubing and cross bracing and including at least a pair of horizontally disposed tubes;

c. elements included in said side means each having ends adapted to be supported on said end members positioned at the opposite ends of the excavation;

d. means on said end members for engaging the ends of said elements (c);

e. means to elongate said elements (c) against said means (d) whereby to press said end members against the opposite ends of said excavation and hold said side means tightly between said means (d) thus providing a rigid framework, said means to elongate including i. threaded means supported on certain of the horizontally disposed tubes of the side means, said threaded means being disposed to rotate around a horizontal axis, and ii. corresponding cooperating threaded elements interfitting with said threaded means, whereby to adjustably fit said framework to the length of the excavation and then to further elongate said side means to produce the desired pressure of the end members against the ends of the excavation.

* * * * *